United States Patent [19]

Zimmerman

[11] Patent Number: 5,005,980

[45] Date of Patent: Apr. 9, 1991

[54] SLUDGE/SOIL MIXING MACHINE

[76] Inventor: Harold M. Zimmerman, R.D. #1, Wabash Rd., Ephrata, Pa. 17522

[21] Appl. No.: 461,371

[22] Filed: Jan. 5, 1990

[51] Int. Cl.[5] ..... B01F 15/04; B01F 15/02

[52] U.S. Cl. ..... 366/162; 241/186 A; 241/193; 366/14; 366/177; 366/297; 366/319; 366/607

[58] Field of Search ..... 366/156, 157, 38, 28, 366/27, 33, 35, 177, 8, 10, 13, 14, 15, 16, 131, 133, 134, 162, 603, 297, 319, 607; 241/186 A, 193

[56] References Cited

U.S. PATENT DOCUMENTS

| | | | |
|---|---|---|---|
| 1,962,778 | 6/1934 | Kranick | 241/186.1 |
| 3,011,793 | 12/1961 | McElhinney | 275/1 |
| 3,345,042 | 10/1967 | Ryan | 366/131 |
| 3,456,925 | 7/1969 | Gallagher | 366/27 |
| 4,443,109 | 4/1984 | Watts | 366/134 |
| 4,487,507 | 12/1984 | Van Wyngaarden | 366/20 |
| 4,712,919 | 12/1987 | Bouldin | 366/133 |

*Primary Examiner*—Robert W. Jenkins
*Attorney, Agent, or Firm*—Larry W. Miller

[57] ABSTRACT

A mixing machine operable to receive quantities of waste material and an inert material in separate hoppers for conveyance to a mixing chamber for uniform mixing thereof in prescribed ratios is disclosed wherein each hopper is provided with rearwardly directed augers to pull material away from the opening from the hopper to the mixing chamber. The mixing chamber includes a rotatable flail rotor operable to engage the supplies of materials being fed thereto and effect a mixing thereof prior to being discharged to a mixing auger for final mixing of the two materials before discharge from the machine. Each component of the machine is hydraulically driven to provide independent operation thereof relative to any other component of the machine. An additive hopper is also provided to discharge a selected amount of an additive into the mixing chamber for selective neutralization of the waste material.

20 Claims, 3 Drawing Sheets

10
12
13
14
15
16
17
19
20
21
22
23
24
26
27
28
30
32
33
35
36
40
41
42
43
44
46
47
48
50
52
53
55
56
59
60
62
64
69
70
73
74
75
78
79
80
83
85
86
87
89
90
92
94
95
96
97
98
99

SLUDGE/SOIL MIXING MACHINE

BACKGROUND OF THE INVENTION

This invention relates generallY to machines operable to process waste materials, such as sewage sludge, for proper disposal thereof, and, more particularly, to an apparatus for mixing such waste material with an inert medium, such as soil, prior to disposition of the combined material.

Regulations of the Environmental Protection Agency (EPA) permit waste material such as sewage sludge to be disposed in the ground if the sludge material is properly mixed with soil prior to being deposited in the ground. The waste material must be uniformly mixed with the otherwise inert soil material in a prescribed ratio, such as three parts soil to each part of sludge material. After being mixed, the combined material can be stockpiled or returned to the ground at a permissible location and time.

Accordingly, it would be desirable to provide a machine that would receive supplies of such waste material and of the otherwise inert soil material and effect a mixing of the two materials in a uniform manner that will satisfy rules and regulations relating to the disposition of the waste material. Any such machine will have to properly handle sludge material, as well as wet soil, both of which can have a high moisture content and a high cohesiveness property that will inhibit movement of the material, as well as the mixing thereof.

SUMMARY OF THE INVENTION

It is an object of this invention to overcome the aforementioned disadvantages of the prior art by providing a machine operable to mix waste material, such as sewage sludge, with soil.

It is another object of this invention to provide a sludge/soil mixing machine that will uniformly mix sludge material with soil in a prescribed ratio.

It is a feature of this invention that the sludge/soil mixing machine uniformly mixes sewage sludge with otherwise inert soil material.

It is an advantage of this invention that the sludge/soil mixing machine mixes waste material, such as sewage sludge, with otherwise inert soil material in such a manner to satisfy current regulations of the Environmental Protection Agency.

It is still another object of this invention that the sludge/soil mixing machine can handle materials having a high moisture content without plugging.

It is still another object of this invention to provide a machine capable of receiving discrete supplies of both the waste material and the soil material for conveyance to a mixing device in prescribed ratios.

It is another feature of this invention that the hoppers carried by the machine are provide with augers to covey the upper portion of the material within the hopper rearwardly away from the opening to the mixing rotor.

It is another advantage of this invention that the material within the hoppers will be conveyed to the mixing chamber without plugging irrespective of the moisture content of the material.

It is yet another object of this invention to provide each hopper with a conveying mechanism to move the material therein toward the mixing chamber.

It is still another feature of this invention that the conveying mechanisms in the respective hoppers are independently driven by a variable speed drive mechanism.

It is still another advantage of this invention that the speeds of the conveying mechanism drives can be selectively varied to change the ratio of the respective materials being conveyed to the mixing chamber.

It is yet another feature of this invention that each operably driven component of the sludge/soil mixing machine is independently driven.

It is yet another advantage of this invention that each driven component of the sludge/soil mixing machine can be operate at a variable speed to provide adequate control of the operation of the machine.

It is yet another object of this invention that uniform mixing of the waste material with the selected soil material is accomplished by a flail rotor rotatably driven within a mixing chamber and operable to discharge the combined material into a mixing auger to effect further mixing of the combined material before discharge from the machine.

It is yet another feature of this invention that the flail rotor is operable to comminute the sludge and soil materials being fed thereto, particularly hard lumps of soil.

It is still a further object of this invention to provide an additive hopper operable to drop an additive, such as lime, into the flow of the waste material being fed into the mixing chamber.

It is a further feature of this invention that the sludge/soil mixing machine can be mounted on a trailer for movement between job sites.

It is a further advantage of this invention that the operably driven components of the sludge/soil mixing machine can be hydraulically driven.

It is yet a further object of this invention to provide a machine operable to uniformly mix waste material with a inert material and which is durable in construction, inexpensive of manufacture, carefree of maintenance, facile in assemblage, and simple and effective in use.

These and other objects, features, and advantages are accomplished according to the instant invention by providing a mixing machine operable to receive quantities of waste material and an inert material in separate hoppers for conveyance to a mixing chamber for uniform mixing thereof in prescribed ratios. Each hopper is provided with rearwardly directed augers to pull material away from the opening from the hopper to the mixing chamber. The mixing chamber includes a rotatable flail rotor operable to engage the supplies of materials being fed thereto and effect a mixing thereof prior to being discharged to a mixing auger for final mixing of the two materials before discharge from the machine. Each component of the machine is hydraulically driven to provide independent operation thereof relative to any other component of the machine. An additive hopper is also provided to discharge a selected amount of an additive into the mixing chamber for selective neutralization of the waste material.

BRIEF DESCRIPTION OF THE DRAWINGS

The advantages of this invention will become apparent upon consideration of the following detailed disclosure of the invention, especially when taken in conjunction with the accompanying drawings wherein.

DETAILED DESCRIPTION OF THE PREFERRED EMBODIMENT

Figure 1:
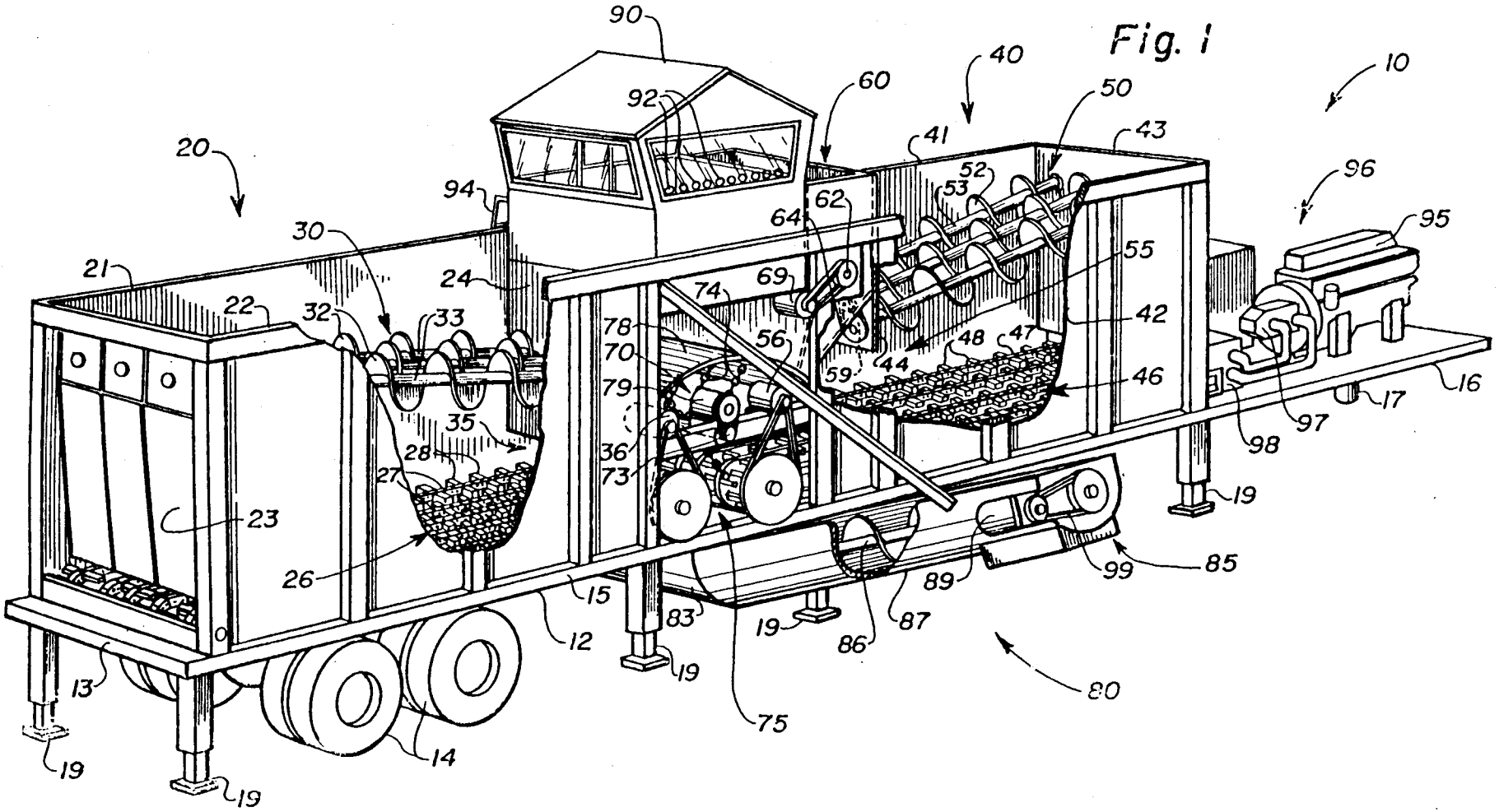
FIG. 1 is a perspective view of a sludge/soil mixing machine mounted on a mobile trailer as seen from the right rear corner of the machine, portions of the side sheets being broken away for purposes of clarity to best reveal the structural aspects incorporating the principles of the instant invention.
Figure 2:
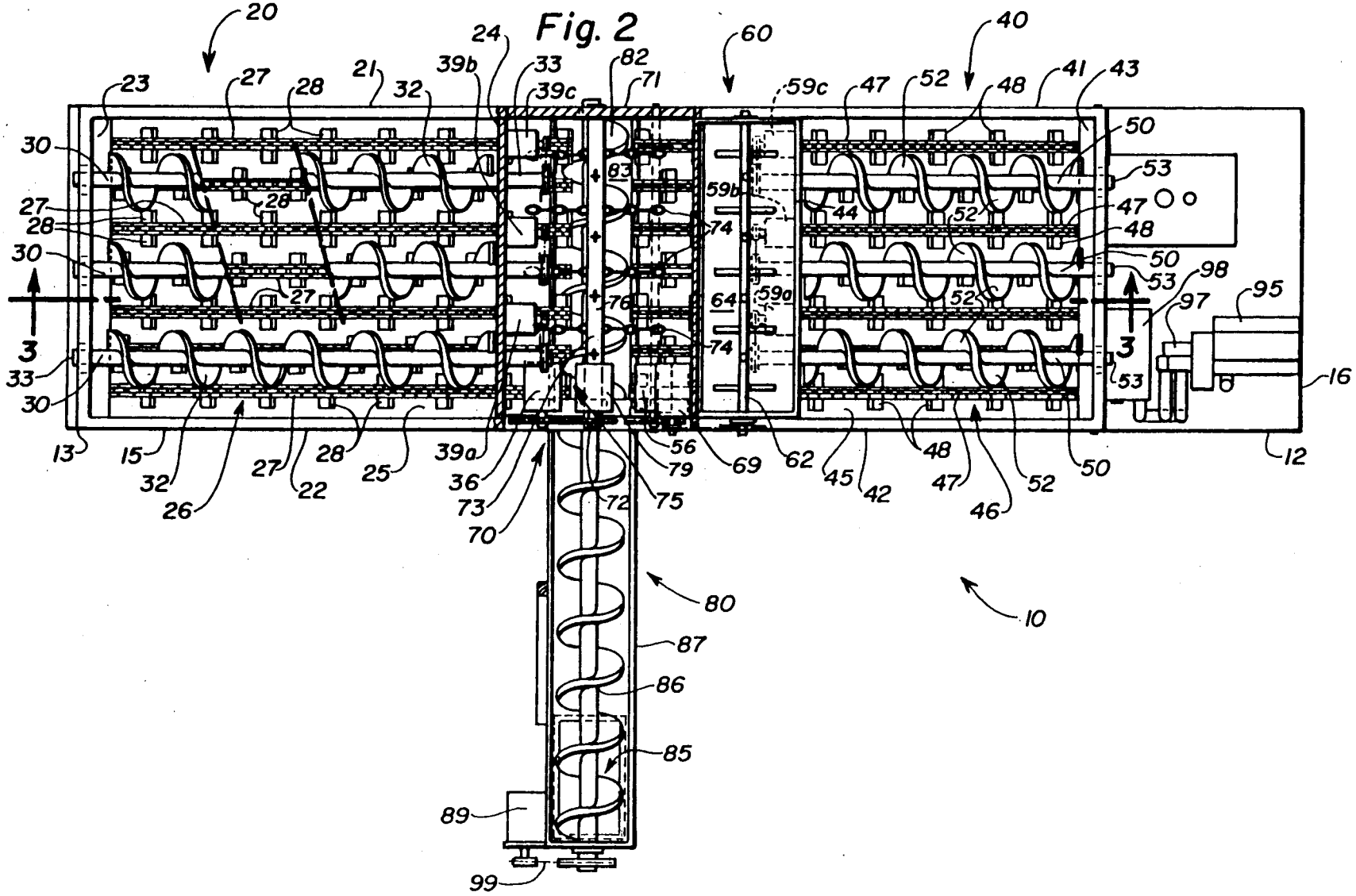
FIG. 2 is a cross-sectional view of the sludge/soil mixing machine corresponding to lines 2—2 of FIG. 3, to show a top plan view of the operative components of the sludge/soil mixing machine, portions of the upper transport augers in the rearmost hopper being broken away to reveal the details of the lower chain conveyors.
Figure 3:
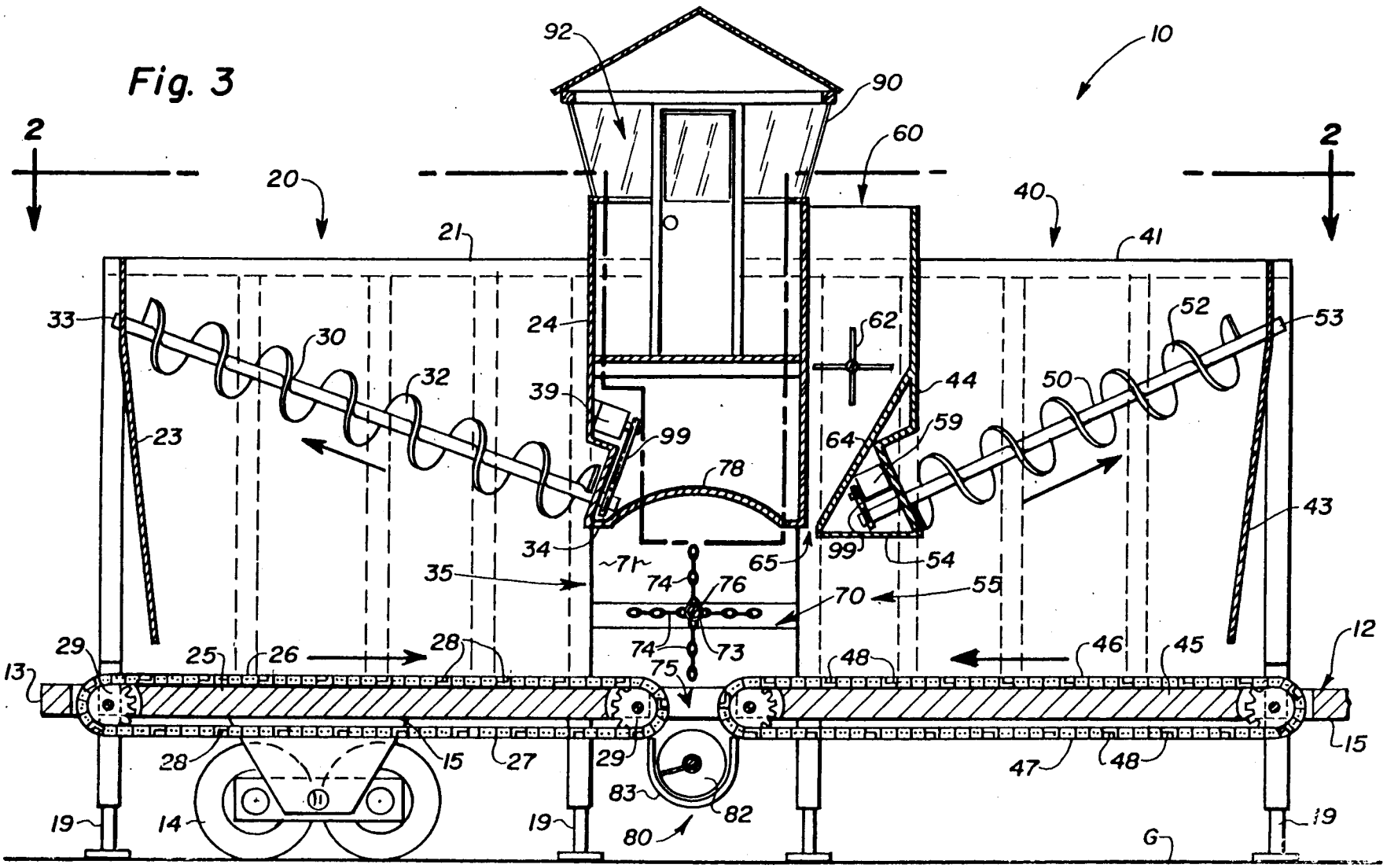
FIG. 3 is a cross-sectional view of the sludge/soil mixing machine corresponding to lines 3—3 of FIG. 2 to show a side elevational view of the machine, the forward portion of the trailer on which the power plant is mounted being broken away.

Referring now to all the FIGS. 1-3, the details of the sludge/soil mixing machine can best be seen. Any left and right references are used as a matter of convenience and are determined by standing at the rear of the machine and facing the forward end which would be connected to a prime mover to provide mobile transport of the machine from job site to job site.

It will be understood that although the sludge/soil mixing machine 10 is depicted as being mounted on a trailer 12 having ground engaging wheels 14 disposed at the rearward end 13 of the trailer 12 and a coupling means 17 disposed at the forward end 16 of the trailer 12 for connection to a prime mover (not shown) such as a truck or a tractor, the machine 10 is not limited to such an embodiment as the machine 10 could be permanently mounted on the ground G, for example. The trailer 12 is also equipped with a plurality of leveling jacks 19 to engage the ground G and effect a leveling of the trailer 12 for proper operation of the machine 10. These leveling jacks 19 can be hydraulically powered or mechanically operated.

The sludge/soil mixing machine 10 is provided with two major hoppers 20, 40 to receive quantities of soil and sludge material, such as sewage sludge, respectively. The rearwardmost hopper 20 is depicted in the drawings as the soil hopper 20, which is defined by left and right transversely spaced side walls 21, 22, an inwardly slanted rear wall 23, a front wall 24 spaced longitudinally of the rear wall 23, and a floor 25 supported by the frame 15 of the trailer 12. The front wall 24 terminates at a given height above the floor 25 for reasons described in greater detail below.

The soil hopper 20 is also provided with a floor conveyor 26 comprised of an endless chain 27 having a plurality of lugs 28 affixed thereto and being entrained around longitudinally spaced sprockets 29 to form a drag conveyor 26 operable in conjunction with the floor 25 to move soil in the hopper 20 forwardly to a mixing chamber 70 past the front wall 24. The soil hopper 20 is also provided with a plurality of transversely spaced transport augers 30 rotatably supported by the rear and front walls 23, 24. The soil hopper 20 can also be provided with an optional screen (not shown) at the top of the hopper 20 to prevent the entry of large objects, such as boulders or stumps that might be in the soil material being delivered into the soil hopper 20.

The transport augers 30 are inclined such that the ends of the transport augers 30 supported by the front wall 24 are lower than the ends of the transport augers 30 supported by the rear wall 23. Each transport auger 30 is provided with conventional spiral flighting 32 affixed to a central shaft 33 and is rotated to convey soil rearwardly from the front wall 24 toward the rear wall 23 to redistribute the soil material within the soil hopper 20 to prevent bridging and to prevent a overload of soil at the front wall 24.

The front wall 24 is spaced above the floor 25 a sufficient distance to form an opening 35 to limit the amount of soil being conveyed to the mixing chamber 70 by the drag conveyor 26 without imposing restrictions on the flow of soil into the mixing chamber 70 to cause the hopper 20 to be plugged. The height of the opening 35 between the front wall 24 and the floor 25 also limits the size of material flowing into the mixing chamber 70 should any large objects such as boulders be deposited in the soil hopper 20.

The forwardmost sludge hopper 40 is constructed similarly to the soil hopper 20. The sludge hopper is defined by transversely spaced left and right side walls 41, 42, an inwardly angled front wall 43, a rear wall 44, and a floor 45 supported on the frame 15 of the trailer 12. The rear wall 44 terminates above the floor 45 a given distance to form an opening 55 therebetween. The height of the opening 55 limits the amount of sludge material within the sludge hopper 40 that can pass into the mixing chamber 70. Although the sludge hopper 40 is depicted in the drawings as being smaller than the soil hopper 20, sizing of the hoppers 20, 40 is not a critical factor; however, as will be noted below in greater detail, the volume of soil material utilized during operation of the machine 10 is greater than the sludge material.

The sludge hopper 40 is also provided with a drag conveyor 46 comprised of an endless chain 27 having a plurality of lugs 28 affixed thereto and being entrained around longitudinally spaced sprockets to be co-operable with the floor 45 to drag sludge material within the sludge hopper 40 toward the mixing chamber 70 through the opening 55. The sludge hopper 40 is also provided with a plurality of transversely spaced transport augers 50 rotatably supported by the front and rear walls 43, 44.

The transport augers 50 are inclined such that the ends of the transport augers 50 supported by the rear wall 44 are lower than the ends of the transport augers 50 supported by the front wall 43. Each transport auger 50 is constructed identically to the soil transport augers 30 including conventional spiral flighting 52 affixed to a central shaft 53 and is rotated to convey sludge forwardly from the rear wall 44 toward the front wall 43 to redistribute the sludge material within the sludge hopper 40 to prevent bridging and to prevent a overload of sludge material at the rear wall 44.

It has been found that the most efficient operation of the machine 10 in the delivery of materials from the hoppers 20, 40 to the mixing chamber 70 will occur when the lowermost edge of the flighting 32, 52 on the transport augers 30, 50 is positioned at or near the same horizontal plane as the bottom edge of the wall 24, 44 adjacent the mixing chamber, defining the upper limits of the openings 35, 55 to the mixing chamber 70. This spacial relationship between the auger flighting 32, 52 and the opening 35, 55 to the mixing chamber prevents material being conveyed toward the mixing chamber 70 from accumulating against the corresponding wall 24, 44, as the transport augers 30, 50 serve to redistribute this material away from the mixing chamber 70.

An optional additive hopper 60 is depicted in the drawings as being positioned above the floor 45 of the sludge hopper 40 between the rear wall 44 and the mixing chamber 70. The deletion of the additive hopper 60 from the machine 10 would result in an increased size of the sludge hopper 40 and a positioning of the rear wall 44 thereof immediately adjacent to the mixing chamber 70, rather than being spaced therefrom a distance equal to the longitudinal depth of the additive hopper.

The additive hopper 60 is provided with a transversely extending agitator 62 to facilitate and to meter the flow of material within the hopper 60 downwardly along the angled floor 64 through the opening 65 into the mixing chamber 70. One skilled in the art will readily realize that alternative conventional conveying mechanisms could be utilized within the additive hopper 60 in lieu of or in addition to the agitator 62 to provide a more positive flow of additive into the mixing chamber 70, rather than relying on the gravity feed system depicted in the drawings.

The mixing chamber 70 is positioned intermediate the soil hopper 20 and the sludge hopper 40 to receive materials from each hopper 20, 40, and from the additive hopper 60, if being utilized, and to effect a mixing of the materials in a suitable manner. The mixing chamber is defined by transversely opposing left and right side walls 71, 72 rotatably supporting a flail rotor 73 having a plurality of chain flails 74 affixed to a central shaft 76 for rotation therewith. It should be noted that the right side wall 72 is not shown in FIG. 1 to permit a better viewing of the operative components therein. The mixing chamber 70 includes an arcuate hood member 78 to retain materials within the mixing chamber 70 and to direct the materials downwardly toward the discharge opening 75 located intermediate the floors 25, 45 of the respective hoppers.

A discharge mechanism 80 is positioned below the mixing chamber 70 and extends outwardly beyond the right side wall 72 of the mixing chamber 70 to deposit the mixed materials outwardly of the machine 10. It should be noted that the discharge mechanism 80 could be configured to discharge the mixed material in any direction relative to the mixing chamber 70. The discharge mechanism 80 includes a first mixing auger 82 housed within a trough 83 positioned immediately beneath the discharge opening 75 of the mixing chamber 70 to receive at least partially mixed materials in proper proportions from the mixing chamber 70.

The discharge mechanism 80 further includes a second mixing auger 86 cojoined with the first mixing auger 82 by a universal joint (not shown) to permit rotation therewith. An alternative embodiment would be to have the first mixing auger 82 be collinear with the second mixing auger 86 and, therefore, extending angularly beneath the discharge opening 75 of the mixing chamber 70. A second trough 87 houses the second mixing auger 87 and, although depicted in a fixed orientation, the second mixing auger 86 and associated trough 87 can be positioned relative to the first mixing auger 82 and associated trough 83 in a similar manner as is known from concrete mixers, to permit a discharge of the mixed material from the second auger trough 87 through the remote discharge opening 85 in a location or orientation desired by the operator.

The operator's compartment 90 is positioned above the mixing chamber 70 between the soil hopper 20 and the sludge hopper 40 for adequate observance of the operation of and of the supplies within each of the hoppers 20, 40 and 60, as well as the operation of the discharge mechanism 80. The operator's compartment 90 houses the control mechanism 92 through which the individual drive mechanisms described in greater detail below can be individually controlled. Access to the operator's compartment 90 can be gained through a conventional ladder 94 representatively shown in FIG. 1.

The operative components of the machine 10 are driven by hydraulic motors powered by an engine 95 mounted on the forward end 16 of the trailer 12. A hydraulic system 96, including a conventional pump 97 and a reservoir 98, is operatively connected to the engine 95 to provide hydraulic fluid under pressure through a conventional hydraulic valve (not shown) operatively associated with the control mechanism 92 to the individual hydraulic motors described below.

Each operable component of the machine 10 is driven by a separate hydraulic motor in flow communication with the hydraulic system 96 so that each component can be independently operated relative to any other operable component. Each operable component is coupled to the corresponding hydraulic motor by an endless chain 99 transferring rotational power therebetween. The drag conveyors 26, 46 are rotatably driven by hydraulic motors 36, 56, respectively. The transport augers 30, 50 are each driven by a separate corresponding hydraulic motors 39*a*, *b*, and *c* and 59*a*, *b*, and *c*, respectively. The agitator 62 is driven by the hydraulic motor 69, while the flail rotor 73 is driven by the hydraulic motor 79 coupled to the shaft 76 and the mixing augers 82, 86 are driven by the hydraulic motor 89 operably coupled to the second mixing auger 86 and supported from the distal end of the second auger trough 87 proximate to the discharge opening 85.

Accordingly, each hydraulic motor 36, 56, 39, 59, 69, 79, and 89 is controlled independently through the control mechanism 92 and can effect operation of the operable component associated therewith at infinitely variable speeds of operation irrespective of the speed of operation of any other operable component on the machine 10. For example, should the soil in the soil hopper 20 become unevenly distributed in the hopper 20, resulting in a piling of the soil in one particular area of the soil hopper 20 adjacent the front wall 24, the operator could increase the speed of operation of the transport auger 30 corresponding to that particular area in the soil hopper 20 to increase the rate of distribution of the soil rearwardly from that portion of the front wall 24 toward the rear wall 25 until the soil is properly distributed.

Furthermore, since the operative components are hydraulically driven, the direction of operation can be reversed as well as the speed of operation infinitely varied within the limits of operation of the motors. Accordingly, the transport augers 30, 50 could be reversed in operation should the respective material within the hoppers 20, 40 be in need of redistribution toward the mixing chamber 70, although the normal mode of operation is intended to redistribute the material away from the mixing chamber 70 because of the tendency of the material to move in mass toward the mixing chamber 70 as induced by the respective drag conveyors.

In the way of further example, regulations of the Environmental Protection Agency EPA) permit sewage sludge to be disposed in the ground if treated with an additive, such as lime, and mixed with otherwise inert soil in a ratio of three parts soil to each part of treated sewage sludge. Accordingly, the normal speeds of operation of the drag conveyors 26, 46 are at a three to one ratio so that the volume of soil conveyed from the soil hopper 20 is three times greater than the volume of sludge conveyed from the sludge hopper 40. Should the relative volumes of materials conveyed from the hoppers 20, 40 be disrupted for reasons such as varying viscosity of the materials, etc., the operator can manipulate the control mechanism 92 to increase or decrease the speed of operation of either of the drag conveyors 26, 46 to attain the desired volumes of materials conveyed into the mixing chamber 70.

Likewise, the speed of operation of the flail rotor 73 can be varied to accommodate both the volume of materials being conveyed from the soil and sludge hoppers 20, 40 and to attain the desired mixing quality and comminution of the material within the mixing chamber 70 before discharge to the first mixing auger 82. As noted above with respect to the transport augers 30, 50, the direction of operation of the flail rotor 73 can be reversed if the operator deems such a change to be advantageous due to the hydraulic driving of the rotation of the flail rotor 73.

The speed of operation of the discharge mechanism 80 can also be varied by the operator to attain satisfactory movement of the mixed material away from the mixing chamber 70 while retaining the mixed material within the mixing augers 82, 86 to effect a complete homogeneous mixture of the two materials before discharge from the machine 10. In operation of the machine 10 where the additive is added to the mixing chamber 70 from the additive hopper 60, the rate of flow of the additive into the mixing chamber 70 can be controlled by varying the speed of operation of the agitator 62.

To place the relative sizes and speeds of operation of the components of the machine 10 in perspective, it should be noted that the machine is intended to be utilized on a standard flat bed trailer 12, thereby generally limiting the width of the hoppers 20, 40, and 60, as well as the operator's compartment, to about eight feet. The length of the hoppers 20, 40 are dependent on the length of the trailer 12, but each hopper can generally be approximately fourteen feet in length. The height of the front wall 24 of the soil hopper 20 and of the rear wall 44 of the sludge hopper 40 above the floors 25, 45, respectively, has been found to provide best operation if maintained in the range of about two feet.

The transport augers 30, 50 are of conventional construction with a spiral flighting 32, 52 welded to a central shaft 33, 53, with each auger 30, 50 having a diameter of about sixteen inches and a length adequate to span the distance between the corresponding front walls 24, 43 and the corresponding rear walls 23, 44 of the hoppers 20, 40 for rotational support thereby and operable connection to the corresponding hydraulic motor to power the operation thereof.

The flail rotor 73 should have an overall diameter, measured from the tip of an extended one of the chain flails 74 to the tip of the opposing chain flail 74, of approximately forty-four inches and be operated at a rotational speed of about 600 revolutions per minute. The mixing augers 82, 86 would also be of conventional construction and have a diameter of about twenty-four inches and be operated at a rotational speed of about 80 revolutions per minute.

The length of the second mixing auger 86 and associated trough 87 can be of any desired length to position the discharge opening 85 at the desired location; however, the second mixing auger 86 and trough 87 must be movable either by pivotal movement to retract the trough 87 and auger 86 against the machine 10 or by disassembling the second mixing auger 86 and associated trough 87 and remote storage thereof, so that the overall width of the machine 10 can be within limits required for over public road transportation of the machine 10 from job site to job site.

The operation of the soil/sludge mixing machine 10 is controlled by the operator from the operator's compartment 90. As noted above, the speed of operation of each of the individual operating components of the machine 10 are independently controlled through manipulation of the control mechanism 92. Supplies of sewage sludge and of otherwise inert soil are loaded into the respective hoppers 40, 20 from external sources and by equipment not associated with the machine 10. If supplies of sludge material and soil are maintained within the respective hoppers 40, 20 and if adequate provision is made for removal of the discharged mixed material from the discharge mechanism 80, the operation of the machine 10 can be substantially continuous.

Once the hoppers 20, 40 are filled with respective supplies of materials and the trailer 12 leveled for most efficient operation of the machine 10 by the leveling jacks 19, the operator starts the operation of the drag conveyors 26, 46 in proper speed ratios to place the desired volumes of the respective materials from the hoppers 20, 40 into the mixing chamber 70. The height of the front wall 24 of the soil hopper 20 and of the rear wall 44 of the sludge hopper 40 limits the amount of material moved by the respective drag conveyors 26, 46 into the mixing chamber 70 without causing major blockage or bridging problems irrespective of the moisture content of the respective materials. To further assist the smooth flow of respective materials into the mixing chamber 70, the operator can control the speed of the relative transport augers 30, 50 to redistribute the materials within the hoppers 20, 40 above the openings 35, 55 away from the mixing chamber 70.

The materials entering the mixing chamber 70 are engaged by the rapidly rotating flail rotor 73 whose chain flails 74 operate to comminute the relative materials as they are discharged off the drag conveyors 26, 46 and to effect a mixing of the two materials within the mixing chamber 70 to at least a partial degree before being discharged through the discharge opening 75 into the discharge mechanism 80. The first mixing auger 82 receives the mixed material from the mixing chamber 70 and conveys the mixed material outwardly away from the mixing chamber 70 to the second mixing auger 86. The operation of the mixing augers 82, 86 and the associated troughs 83, 87, respectively, effect a further mixing of the materials within the discharge mechanism 80 before being discharged from the machine 10 through the discharge opening 85.

The combined operation of the flail rotor 73 and the mixing augers 82, 86 on the materials to be combined effect a homogeneous mixture of the two materials in the proportions in which the two materials are fed into the mixing chamber 70 by the two drag conveyors 26, 46. The amount of moisture in the materials in either of the hoppers 20, 40 does not significantly affect the operation of the machine 10 due to the aggressive comminuting nature of the flail rotor 73 engaging the materials within the mixing chamber 70. The relatively slow speeds of material entering the mixing chamber 70 from the drag conveyors 26, 46 combined with the relatively rapid speed of rotation of the flail rotor 73 permits this aggressive comminution and initial mixing of the two materials before being discharged into the discharge mechanism 80.

The above description of the operation of the soil/-sludge mixing machine 10 assumes a pre-treating of the sludge material prior to being placed into the sludge hopper 40, in which case the mixed material discharged from the machine through the discharge opening 85 can be immediately disposed without the need for stockpiling. However, the pretreating of the sludge material may not be desirable, in which case the additive hopper 60 comes into use. One skilled in the art will readily recognize that additional additive hoppers could be provided for discharge into the mixing chamber or into the flow path of the sludge material prior to being engaged by the flail rotor 73, if desired. One additional location for such an additional additive hopper would be on the opposing side of the operator's compartment from the additive hopper 60, making the machine 10 generally symmetrical on opposite sides of the operator's compartment.

Typically, sewage sludge is treated with lime prior to being mixed with soil, the treated sewage sludge being stockpiled prior to any mixing operation to provide adequate treatment of the sludge material. The lime can be added to the mixing chamber 70 from the additive hopper 60 to effect a treating of previously untreated sludge material during the mixing stage. The appropriate supplies of lime are maintained within the hopper 60 by external means and fed into the mixing chamber 70 at a rate to provide adequate amounts of lime to the volume of untreated sludge material entering the mixing chamber 70. The mixed material discharged from the machine 10 should then be stockpiled to provide adequate treatment before ultimately being disposed in the ground.

It will be understood that changes in the details, materials, steps, and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description may be employed in other embodiments without departing from the scope of the invention. Accordingly, the following claims are intended to protect the invention broadly as well as in the specific form shown.

Having thus described the invention, what is claimed is:

1. A mixing machine for homogeneously mixing two solid materials, comprising:

a support frame;

a mixing chamber centrally mounted on said support frame;

a first hopper mounted on said support frame for holding a supply of a first material on one side of said mixing chamber, said first hopper having a first conveyor means for moving said first material from said first hopper through a first discharge opening into said mixing chamber;

a second hopper mounted on said support frame for holding a supply of a second material on the opposing side of said mixing chamber from said first hopper, said second hopper having a second conveyor means for moving said second material from said second hopper through a second discharge opening into said mixing chamber;

rotor means rotatably supported within said mixing chamber to engage both said first and second materials entering said mixing chamber and to effect both a comminuting and a mixing of said first and second materials while in said mixing chamber to form a mixed material, said rotor means further being operable to discharge said mixed material through a discharge opening in said mixing chamber;

discharge means supported from said support frame in flow communication with said discharge opening in said mixing chamber to receive said mixed material from said rotor means, to effect a further mixing of said mixed material, and to effect a discharge of the mixed material remotely from said machine; and power means operably connected to said first conveyor means, said second conveyor means, said rotor means, and said discharge means to drive the operation thereof.

2. The mixing machine of claim 1 wherein said conveying means are drag conveyors co-operable with a floor of each respective hopper to move the respective materials to said mixing chamber.

3. The mixing machine of claim 1 wherein said rotor means is a flail rotor having a plurality of flail members circumferentially mounted to a central shaft member to be rotatable therewith for engagement with said first and second materials entering said mixing chamber.

4. The mixing machine of claim 3 wherein said flail members are chain flails.

5. The mixing machine of claim 1 wherein said discharge means includes an auger means operable to effect a further mixing of said mixed material and to effect a conveying of the mixed material away from the mixing chamber.

6. The mixing machine of claim 5 wherein said auger means includes a first mixing auger disposed in flow communication with the discharge opening of said mixing chamber and a second mixing auger operably connected to said first mixing auger to convey said mixed material away from said first mixing auger, both said first and second mixing augers having an associated trough and being operable to further mix said mixed material.

7. The mixing machine of claim 6 wherein said second mixing auger trough has a remote discharge opening to effect a discharge of said mixed material remotely from said mixing chamber.

8. The mixing machine of claim 1 wherein each said hopper is provided with a plurality of transversely disposed transport augers spaced above a corresponding floor member of each respective said hopper.

9. The mixing machine of claim 8 wherein each said transport auger is operable to redistribute material engaged therewith away from said mixing chamber.

10. The mixing machine of claim 9 wherein each said transport auger includes flighting having a lowermost periphery of movement lying in substantially the same horizontal plane as the top of the respective opening from the corresponding hopper to said mixing chamber.

11. The mixing machine of claim 1 further comprising an additive hopper supported from said support frame for selectively discharging an additive material into said mixing chamber to be combined with said first and second materials before being discharged to said discharge mechanism.

12. The mixing machine of claim 11 wherein said additive hopper includes an agitator operably driven by said power means to meter the flow of additive to said mixing chamber.

13. The mixing machine of claim 1 wherein said power means includes a plurality of hydraulically driven motors in flow communication with a hydraulic system powered from an engine mounted on said support frame, each said motor being operably associated with an operable component of said mixing machine to permit independent operation of each of the operable components.

14. The mixing machine of claim 13 wherein said hydraulic motors permit reversible operation of said operable components.

15. The mixing machine of claim 1 wherein said support frame includes ground engaging wheels to mobilely support said support frame over the ground and a coupling means to permit connection to a prime mover for mobile transport over the ground, said support frame further including a plurality a leveling jacks to level said support frame for operation of said machine.

16. A method of mixing a sludge material with an inert material in prescribed proportions comprising the steps of:

loading supplies of both said sludge material and said inert material into respective hoppers;

conveying said sludge material and said inert material into a mixing chamber at respective rates of speed corresponding to the prescribed mix proportions of the two materials;

engaging said sludge material and said inert material with a rotor means in said mixing chamber to comminute said materials and to effect a combining of said sludge material with said inert material in said prescribed proportion to form a mixed material;

discharging said mixed material from said mixing chamber into a discharge mechanism including an auger means to convey said mixed material away from said mixing chamber;

further mixing said mixed material by said auger means while conveying said mixed material away from said mixing chamber; and discharging said mixed material remotely from said mixing chamber.

17. The method of claim 16 further including the step of:

redistributing the material in each respective hopper simultaneous with said conveying step to facilitate the flow of each said material to said mixing chamber.

18. The method of claim 16 further including the step of:

adding an additive from an additive hopper into said mixing chamber during said engaging step to combine with said sludge material and said inert material to form said mixed material.

19. The method of claim 16 further including the step of:

limiting the volume of materials being conveyed to said mixing chamber by controlling the rate said materials are being conveyed from the respective said hopper and by restricting the area of the discharge opening between the respective said hopper and said mixing chamber.

20. The method of claim 16 wherein all of said steps are performed simultaneously to provide a substantially continuous mixing process.

* * * * *